US005207056A

United States Patent [19]

Benninger

[11] Patent Number: 5,207,056

[45] Date of Patent: May 4, 1993

[54] METHOD AND ARRANGEMENT FOR CONTROLLING THE FUEL FOR AN INTERNAL COMBUSTION ENGINE HAVING A CATALYZER

[75] Inventor: Nikolaus Benninger, Vaihingen/Enz, Fed. Rep. of Germany

[73] Assignee: Robert Bosch GmbH, Stuttgart, Fed. Rep. of Germany

[21] Appl. No.: 644,012

[22] Filed: Jan. 22, 1991

[30] Foreign Application Priority Data

Jan. 20, 1990 [DE] Fed. Rep. of Germany ..... 4001616

[51] Int. Cl.[5] ..... F01N 3/20

[52] U.S. Cl. ..... 60/274; 60/276; 60/285; 123/691; 123/696

[58] Field of Search ..... 60/274, 276, 285; 123/691, 696

[56] References Cited

U.S. PATENT DOCUMENTS 3,875,907 4/1975 Wessel ..... 123/696
4,140,086 2/1979 Schnürle ..... 123/696
4,231,334 11/1980 Peter .
4,235,204 11/1980 Rice ..... 60/276
4,251,989 2/1981 Norimatsu ..... 60/276
4,779,414 10/1988 Nagai ..... 60/276

FOREIGN PATENT DOCUMENTS

WO90/05240 5/1990 European Pat. Off. .

*Primary Examiner*—Douglas Hart
*Attorney, Agent, or Firm*—Walter Ottesen

[57] ABSTRACT

The arrangement according to the invention permits the optimal control of the air/fuel ratio of an air/fuel mixture supplied to an internal combustion engine while considering the gas storage capability of a catalyzer. The degree of conversion of the catalyzer is dependent upon the oxygen content of the exhaust gas which is available. Since this degree of conversion is partially influenced by the oxygen given off by the catalyzer, a targeted enrichment or leaning of the air/fuel ratio can optimize the degree of conversion of the catalyzer.

11 Claims, 5 Drawing Sheets

METHOD AND ARRANGEMENT FOR CONTROLLING THE FUEL FOR AN INTERNAL COMBUSTION ENGINE HAVING A CATALYZER

FIELD OF THE INVENTION

The invention relates to a method for optimally controlling the air/fuel ratio of an air/fuel mixture supplied to an engine. The method is carried out by means of at least one lambda probe mounted in the exhaust gas system of the engine ahead of a catalyzer with the gas storage capability of the catalyzer being utilized. The invention also relates to an arrangement for carrying out the method of the invention.

BACKGROUND OF THE INVENTION

It is generally known to convert toxic components of the exhaust gas of an internal combustion engine such as HC, $NO_x$ and CO by means of a catalyzer which is mounted in the exhaust gas system of the engine. The toxic components are converted into non-poisonous gases to the greatest extent possible.

What is however decisive for the so-called degree of conversion is that the oxygen content of the exhaust gas lies within optimal values. For a so-called three-way catalyzer, these optimal values lie in a narrow range about the value which corresponds to an air/fuel mixture of lambda equals 1.

In order to maintain this tight range, it is conventional to control the air/fuel ratio for an engine by means of oxygen probes which are disposed in the exhaust gas system of the engine.

The control operation can be accelerated especially in transition regions. For this purpose, and in addition to the control based on the signal of the oxygen probe, the determination of a so-called precontrol value takes place based upon the operating characteristic variables of the engine such as the air quantity Q supplied thereto and the engine speed n. The determination of the air quantity Q can take place in different ways such as by determining the opening angle of a throttle flap or based on the signal of an air flow sensor.

The precontrol value determined on the basis of Q and n is corrected in accordance with the signal of the oxygen probe in such a manner that the optimal air/fuel mixture is determined. This corrected signal then controls a fuel metering arrangement which meters the optimal quantity of fuel to the engine.

If a fuel injection unit is utilized as the fuel metering arrangement, then the drive signal supplied thereto constitutes a so-called injection time ti which, for the required conditions such as constant fuel pressure ahead of the injection valves and the like, is a direct measure for the fuel quantity supplied per work stroke.

The drive signal for other fuel metering arrangements is determined in a corresponding manner. This is known to persons in the field and the description which follows will be made with reference to a fuel injection unit but the invention should not be construed as to be limited thereto.

Published international application WO90/05240 discloses a system wherein two lambda probes are used to control the air/fuel mixture. A first one of the probes is disposed ahead of the catalyzer and the second one downstream of the catalyzer.

The signal of the second lambda probe is compared to a desired value and the difference of the two values is integrated and the value obtained in this way functions as the desired value for the signal of the first lambda probe.

It has also been shown that modern three-way catalyzers exhibit a gas storage capability and especially an oxygen storage capability of approximately 1.5 liters.

This means that when the engine emits an exhaust gas composition having an increased oxygen content, which corresponds to a lean air/fuel mixture, this is partially stored in the catalyzer.

For a rich air/fuel mixture, the exhaust gas of the engine is deficient in oxygen. In this case, the oxygen stored in the catalyzer is again emitted. As indicated above, the degree of conversion in a region about lambda=1 is optimal. If the engine is now supplied with a rich air/fuel mixture and the catalyzer supplies a portion of its stored oxygen, then this leads temporarily to an increase in the degree of conversion compared to that degree of conversion which corresponds to the air/fuel mixture which is supplied.

The evaluation of the gas storage capacity of a catalyzer is disclosed in U.S. Pat. No. 4,231,334. A system is disclosed here for determining the proportions of the air/fuel mixture supplied to an engine which utilizes the gas storage effect of a catalyzer.

The system described in U.S. Pat. No. 4,231,334 is applied in internal combustion engines which have at least two oxygen probes in their exhaust gas system and wherein the output signals are integrated and are utilized in a supplementary manner for precontrol for the constituent determination of the air/fuel mixture.

The special feature of the system disclosed in U.S. Pat. No. 4,231,334 is that the value computed by the mixture preparation unit for the composition of the mixture is wobbled about a pregiven value such as $\lambda=1$. It has been further shown that exhaust gas catalyzers have, in a specific manner, a gas storage capacity which can be described as a first approximation by a delay of the first order. Accordingly, if the composition of the mixture to be combusted is wobbled at a relatively high frequency for example with a wobble frequency of $f_{min}>2$ Hz about a pregiven lambda value, approximately $\lambda=1$, then it can be expected that the catalyzer acts on the exhaust gas composition so as to form a mean value.

The system disclosed in U.S. Pat. No. 4,231,334 does not however permit a targeted enrichment or leaning of the air/fuel ratio about a pregiven desired value whereby the gas storage effect of the catalyzer can be utilized in a still better manner and the toxic components of the exhaust gas can be considerably reduced.

SUMMARY OF THE INVENTION

In contrast to the foregoing, it is an object of the invention to provide a method for controlling the air/fuel ratio of an air/fuel mixture supplied to an engine wherein improved usage of the gas storage effect of the catalyzer is made thereby considerably reducing the toxic components of the exhaust gas. It is another object of the invention to provide an arrangement for carrying out the method of the invention.

According to the method of the invention, the air/fuel mixture is deliberately enriched or leaned about a pregiven desired value $\lambda_S$ so that the desired value can be maintained at its mean value and thereby can increase the degree of conversion of the catalyzer.

It is advantageous to utilize the signal of a second oxygen probe, which is arranged downstream of the catalyzer, for generating a desired value $\lambda_s$ for the probe ahead of the catalyzer.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
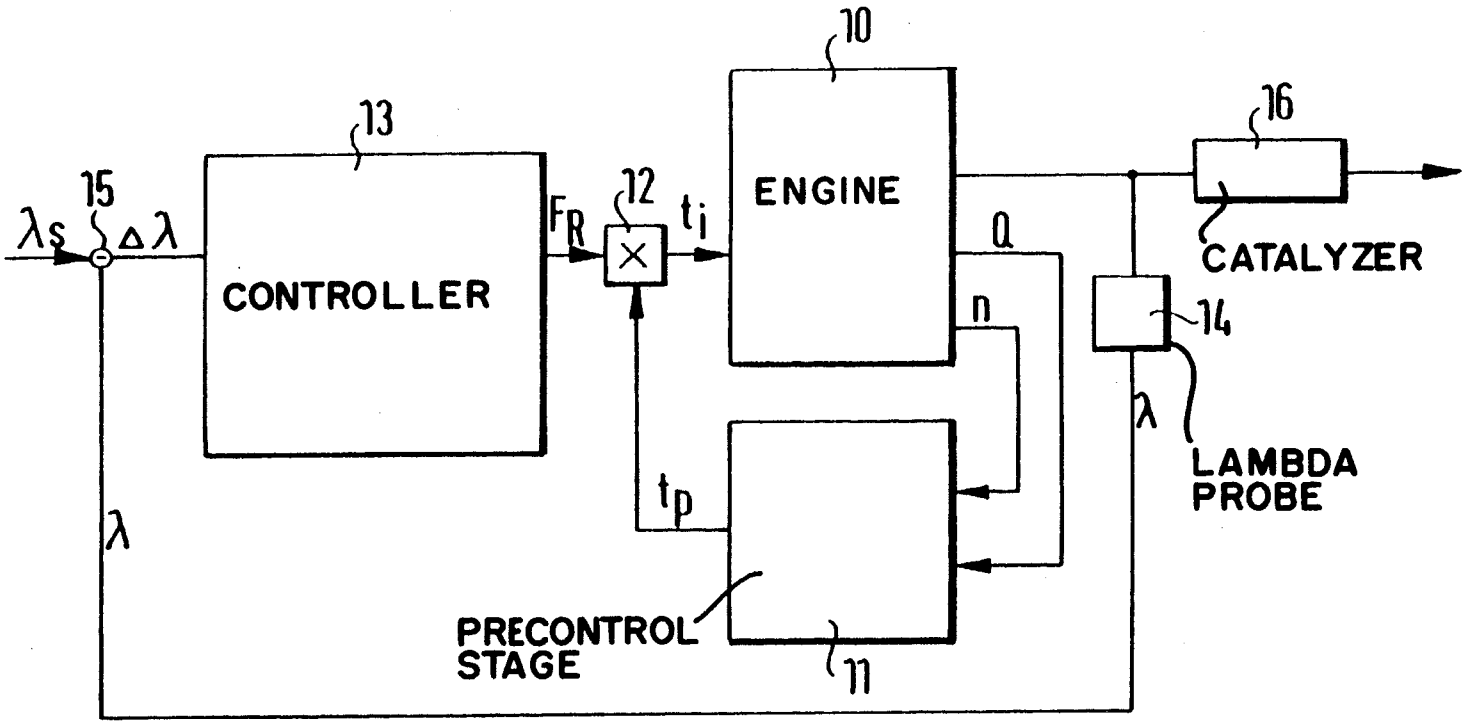
FIG. 1 (PRIOR ART)
FIG. 1 is a block diagram of an arrangement for controlling the air/fuel mixture in accordance with the state of the art.

In the description which follows, only those control and actuating components for operating the internal combustion engine are mentioned which are important for explaining the invention. It is understood that further steps are required in order to operate an engine to satisfy the exhaust gas requirements which are always being made more stringent. The areas of tank ventilation, idle regulation, exhaust gas feedback and the like are areas wherein ever stricter controls are imposed.

These areas are known to persons working in the field and it is understood that individual or several of these areas can be operated in combination with the system of the invention.

Furthermore, it is likewise possible to adapt individual drive signals of the mentioned areas and also of the system of the invention in dependence upon operating characteristic variables of the engine. This can take place in that drive values are stored in a memory having different areas ($8\times8$) which are drivable via operating characteristic variables which describe a specific operating region of the engine. These drive values are used as precontrol values when the engine is again driven in a specific operating area.

Adaptation methods are also known so that they do not have to be described in greater detail here.

The steps shown in the drawing for controlling the engine are shown separately in order to explain the invention. Conventionally, these stages together with further control stages already mentioned in part are integrated into an electronic control unit or part of a control program for a microcomputer which can be configured as part of the electronic control unit.

It should be noted that the connecting lines between the control stages and/or from the sensors or to the actuators can be configured as electrical, optical or other suitable connections.

In FIG. 1, reference numeral 10 identifies an internal combustion engine and 11 indicates a precontrol stage to which, for example, operating characteristic variables such as engine speed n and the air quantity Q drawn in by the engine by suction are supplied. The output signal tp of the precontrol stage 11 is supplied to a multiplier stage 12 which receives the control signal $F_R$ of a controller 13 as a further signal. A difference formed by a subtraction stage 15 is supplied as an input signal to the controller 13. The difference is formed from a pregiven desired value and a measured value $\lambda$ which is formed by a lambda probe 14 arranged in the exhaust gas system of the engine 10 ahead of a catalyzer 16. The output signal ti of the multiplier stage 12 functions to drive injection valves (not shown) which supply the engine with the necessary fuel quantity.

The system shown in FIG. 1 is state of the art and is known per se. For this reason, it is only necessary to briefly discuss its operation. The oxygen content of the exhaust gas of the engine 10 is measured by the lambda probe 14 and is a measure for the air/fuel ratio supplied to the engine. Based on the difference value $\Delta\lambda$ computed by the subtraction stage 15, the controller 13 forms a control signal $F_R$ which corrects the signal tp emitted by the precontrol stage 11 in the multiplier stage 12 so that a value for the injection time ti is present whereby the injection valves (not shown) are driven. The controller 13 is usually configured as a combination of a two-point component and a proportional-integral controller (PI controller).

The exhaust gases of the engine 10 reach the catalyzer 16. The catalyzer converts toxic exhaust gas components such as HC, CO and $NO_x$ largely into non-poisonous gases which reach the ambient.

Figure 2:
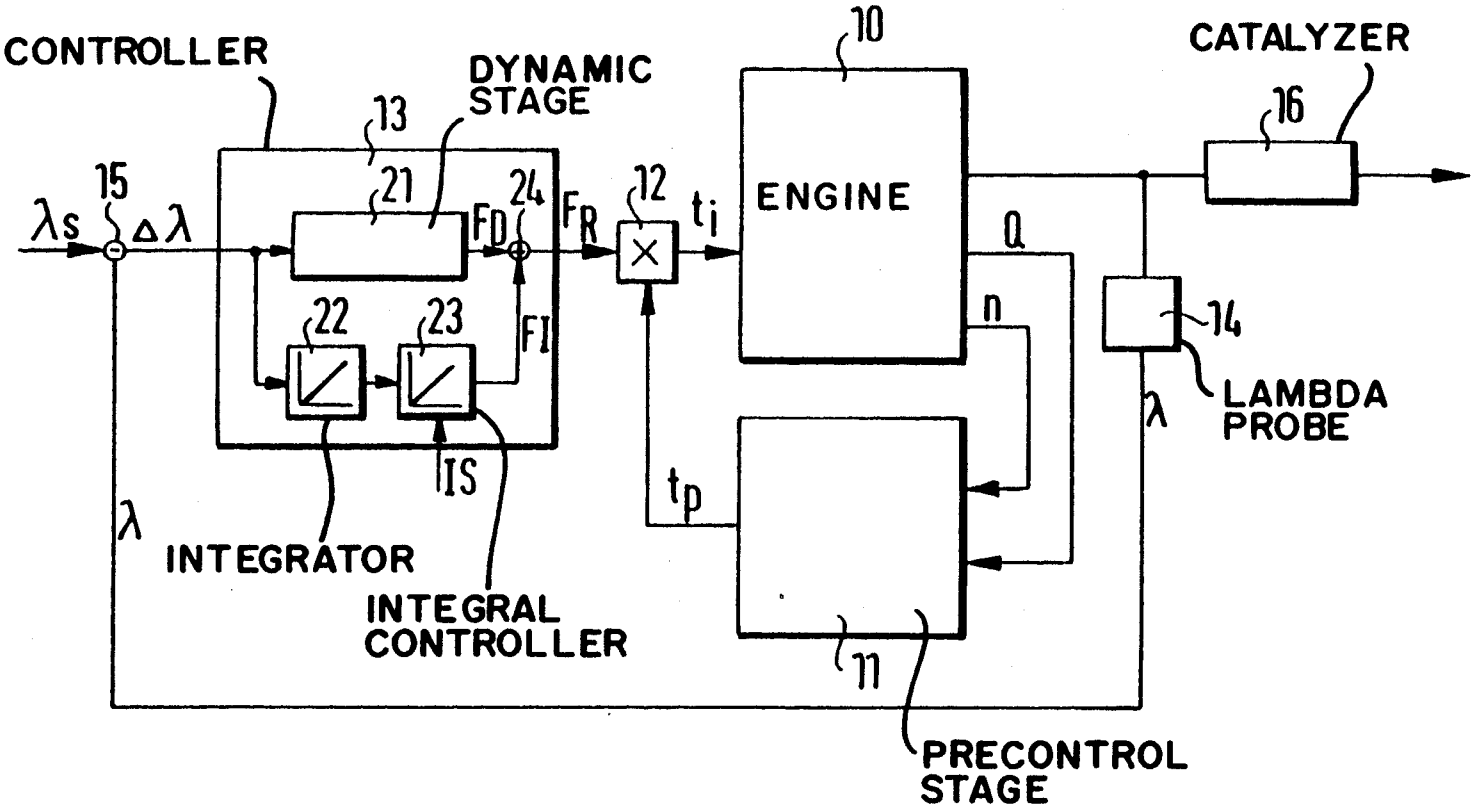
FIG. 2 is an arrangement according to the invention wherein the gas storage capability of a catalyzer is considered.

FIG. 2 shows a preferred embodiment of the arrangement according to the invention. In FIG. 2, stages and means which have been used in the arrangement shown in FIG. 1 are utilized and the same reference numerals are applied.

A special configuration of the controller 13 used is essential in the preferred embodiment. The stages of the controller 13 essential for the description of the invention are, according to FIG. 2, a stage 21 for influencing the dynamic, that is, for rapid control. This stage is identified in the following as dynamic stage 21 and is supplied at its input with the difference formed by the subtracting stage 15. This difference is also supplied to an integrator 22 which emits its signal to an integral controller 23 which also receives a desired value IS and emits as its output signal a control value Fi to a logic stage 24 which also receives the output signal (control value $F_D$) of the dynamic stage 21. The logic stage 24 supplies its output signal $F_R$ to the multiplier stage 12 where the value for the injection time ti is formed.

Figure 3:
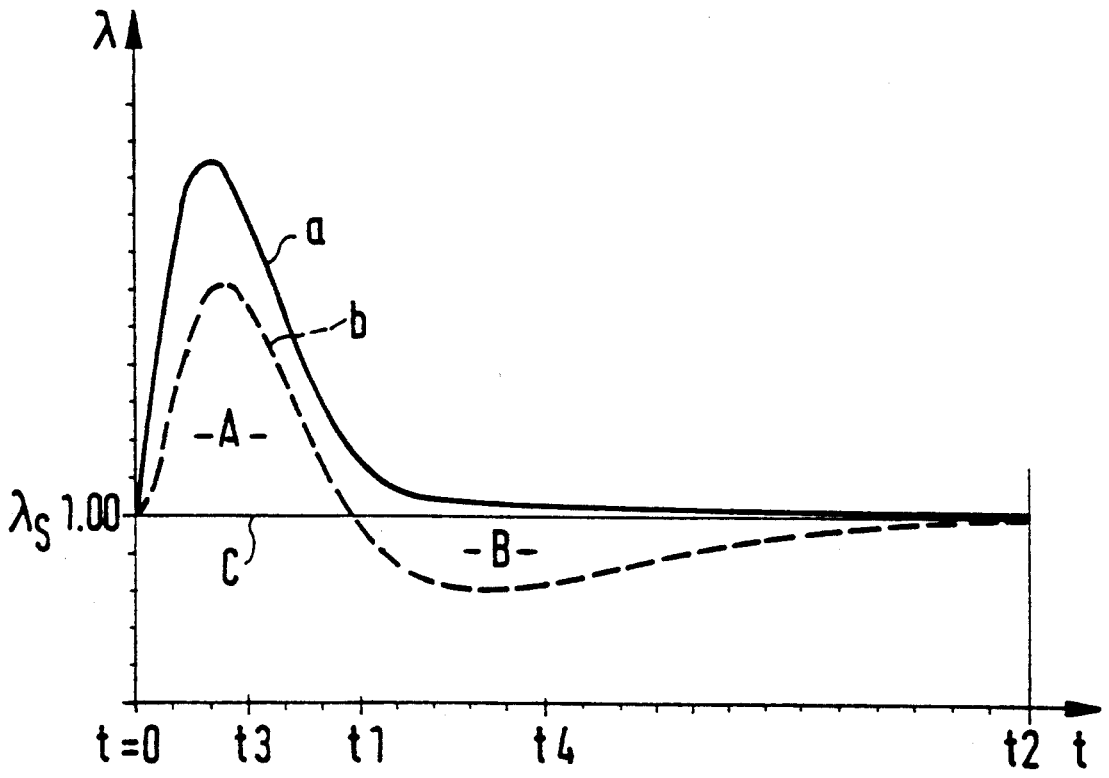
FIG. 3 shows the air number $\lambda$ as a function of time for a conventional system and for an arrangement according to the invention.

The operation of the controller 13 in the embodiment according to the invention and according to the state of the art is first explained with respect to FIG. 3.

In FIG. 3, the measured air number $\lambda$ is shown as a function of time. It is assumed that the air/fuel mixture corresponds to the desired value $\lambda_s$, for example $\lambda_s=1$, at $t<0$. At $t=0$, leaning takes place so that lambda becomes greater than 1 ($\lambda>1$). This can be caused by control oscillations such as during dynamic operation between different operating ranges as is the case during acceleration. If steady-state operation is presumed thereafter, then the controller 13 of FIG. 1 (see curve a of FIG. 3) effects a control of $\lambda$ to the desired value $\lambda_s$ which corresponds to an asymptotic adjustment. That is, the actual value reaches the desired value only very slowly but does not extend below this value.

In contrast to the controller shown in FIG. 1, the controller 13 according to the invention shown in FIG. 2 causes the actual value $\lambda$ to be controlled below the desired value $\lambda_s$ and thereafter the actual value $\lambda$ is brought from below up to this desired value as shown by curve b of FIG. 3.

Essential here are that the areas A and B which are disposed respectively above and below line C of the desired value. The value of these areas can be determined mathematically by integrating from: $\Delta\lambda=\lambda_s-\lambda$ over time with each area being computed between two zero crossovers. Thus, $$A=\int_{t=0}^{t1}\Delta\lambda\,dt \quad \text{and} \quad B=\int_{t1}^{t2}\Delta\lambda\,dt.$$

If the integrals are approximated by a summation, then the following applies:

$$A=\sum_{t=0}^{t1}\Delta\lambda\cdot\Delta t \quad \text{and} \quad B=\sum_{t1}^{t2}\Delta\lambda\cdot\Delta t$$

where $\Delta t$ represents time intervals which subdivide the time durations between the zero crossovers to an adequate extent.

For optimally utilizing the gas storage capability of the catalyzer, the amounts of the areas A and B must, according to the invention have a pregiven difference, that is, A−B=IS. In some cases, it has been shown to be advantageous if the area A is as large as the area B, that is, A=B (IS=0). The areas above the line C are counted as negative and below the line C as positive. For this reason, and as will be explained below, the method of the invention causes the total sum of the areas to have a specific value such as zero when, because of control oscillations, the curve b (actual value) crosses the line C (desired value) several times. That is, the value of the sum taken over the areas above and below line C is not limited by the summation over one oscillation period (t=0, t2) but instead can be formed over any desired pregiven time interval and can be adjusted to the desired value IS.

Figure 4:
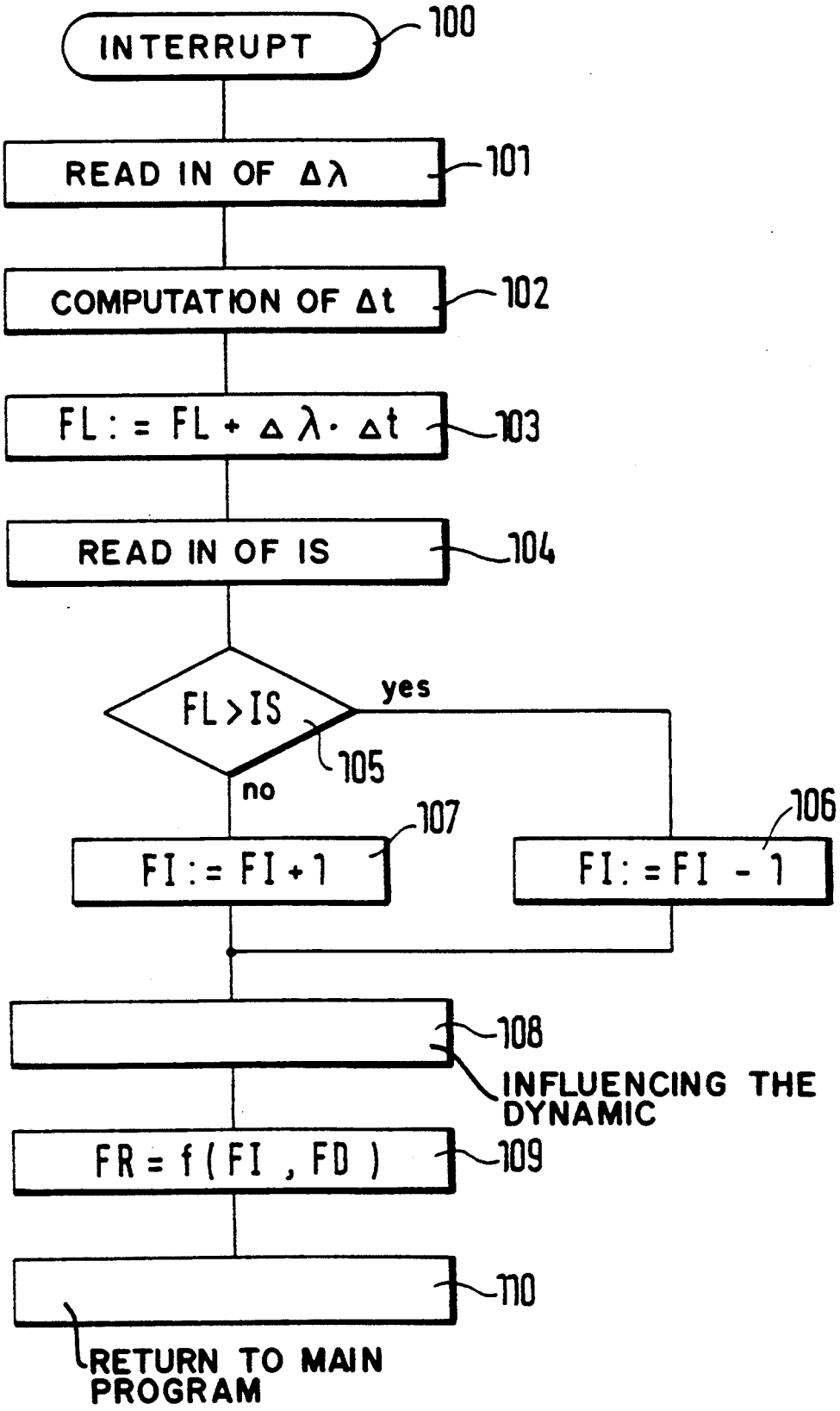
FIG. 4 is a flowchart for describing the method of the invention.

The method according to the invention and the operation of the arrangement for carrying out the invention is described with respect to the sequence shown in FIG. 4.

It is here emphasized that the steps shown in FIG. 4 are only those required to provide an understanding of the invention. Other steps with respect to the following are included under the term main program shown in FIG. 4, namely: steps for determining or evaluating adaptive precontrol variables, the consideration of engine and air temperatures, the areas of tank ventilation as well as other areas which are known per se. The above subject matter can be included individually or in combination with the invention. The flowchart according to FIG. 4 starts with step 100, namely, an interrupt which leads from the main program to the method according to the invention.

Thereafter, the value $\Delta\lambda$ is supplied to the integrator 22 (step 101) which was determined in the subtraction step 16. The integrator 22 contains a time component (not illustrated) which is usually realized as a counter and determines a time difference $\Delta t$ (step 102) which corresponds to the time interval between the last and the present pass-through of step 102. The integrator 22 computes the area value $FL=\Sigma\Delta\lambda\cdot\Delta t$ (step 103), which corresponds approximately to an integral function, by means of the successive computation of $FL:=FL+\Delta\lambda\cdot\Delta t$.

The result from step 103 is a summation of the areas A and B according to FIG. 3 starting at t=0 up to a specific time point. Here, an area A above line C, that is the area of the desired value $\lambda_s$, is counted negatively since $\Delta\lambda=\lambda_s-\lambda<0$ and $\Delta t$ is always positive and an area B below the desired value $\lambda_s$ is counted as positive since $\Delta\lambda=\lambda_s-\lambda>0$. If the assumption is made that the method has been started at t=0 (see FIG. 3) and the sequence of the method is at t3<t1, then the area value FL first decreases further. For a sequence of the method to time point t4>t1, the value FL becomes greater with the next pass-through. The value FL is supplied by the integrator 22 to an integral controller 23 which processes the value FL together with the desired value IS (step 104). In step 105, the value FL is compared to the desired value IS. If FL>IS, then the integral control value FI is reduced by 1 in step 106. However, if FL is not greater than IS, then step 107 follows wherein FI is increased by 1.

After step 106 or 107 has been passed through, the method continues further with step 108. There, the dynamic control value $F_D$ is formed by the dynamic stage 21 which can contain, for example, a proportional and/or differential controller. The dynamic control value $F_D$ is formed on the basis of the difference $\Delta\lambda$. In this way, a rapid reaction takes place in response to the difference value $\Delta\lambda$.

The dynamic control value $F_D$ is connected to the integral control value FI (step 109) by the logic stage 24 and this leads to the control factor $F_R$ (step 109). Thereafter, the method of the invention again goes into the main program (step 109). There, the control factor $F_R$ is multiplied by the basic injection time tp in the multiplier stage 12 in a known manner.

Further multiplicative corrections by means of adaptively determined values such as air temperature and the like can likewise be considered here. Additive corrections, determined, for example, adaptively or based on battery voltage can be considered by an adding stage (not shown). These corrections are known and require no further explanation here since they do not include the invention. All of the corrections mentioned above result in the value ti for driving the fuel valves which meter the required quantity of fuel to the engine.

Figure 5:
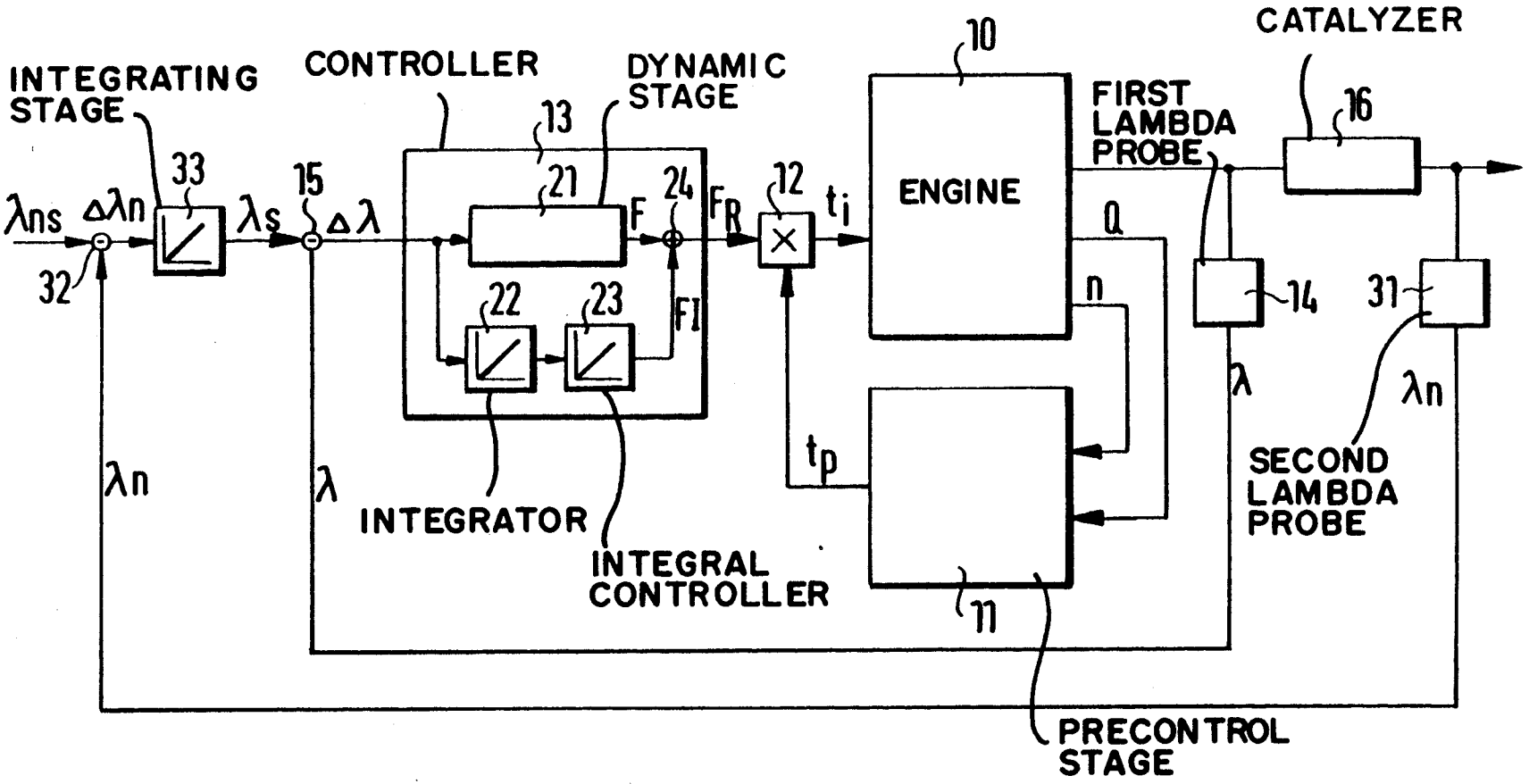
FIG. 5 is another embodiment of the arrangement according to the invention wherein the arrangement has a second lambda probe.

A second embodiment of the invention is shown in FIG. 5. Here, stages which correspond to those in FIGS. 2 and 4 are provided with like reference numerals.

In addition to what has been described above, a second lambda probe 31 is mounted behind the catalyzer 16 and this second lambda probe emits a signal $\lambda_n$. The signal $\lambda_n$ is compared to a desired value $\lambda_{ns}$ in an additional subtraction stage 32 and the difference $\Delta\lambda_n$ is advantageously integrated in a integrating stage 33.

The output signal of integrating stage 33 serves as a desired value $\lambda_s$ for the control by means of the forward lambda probe. The value $\Delta\lambda$ is then determined by the subtraction stage 15 and is read in in step 101 of the method according to the invention. As mentioned, the determination of the control desired value by means of a second lambda probe which is mounted downstream of the catalyzer is known per se. Accordingly, no details are required at this point in the disclosure.

The system according to the invention permits the optimal control of the air/fuel ratio of an air/fuel mixture supplied to an internal combustion engine while considering the gas storage capability of a catalyzer. The degree of conversion of the catalyzer is dependent upon the oxygen content of the exhaust gas which is available to the catalyzer. Since the degree of conversion is partially influenced by the oxygen given off by the catalyzer, the degree of conversion of the catalyzer can be optimized by a targeted enrichment or leaning of the air/fuel ratio.

It is understood that the foregoing description is that of the preferred embodiments of the invention and that various changes and modifications may be made thereto without departing from the spirit and scope of the invention as defined in the appended claims.

What is claimed is:

1. A method for controlling the air/fuel ratio of an air/fuel mixture supplied to an internal combustion engine equipped with a catalyzer having a gas storage capability, the method comprising the steps of:

utilizing at least one lambda probe arranged in the exhaust gas system of the engine upstream of the catalyzer;

enriching and leaning the air/fuel ratio about a pregiven desired value $\lambda_s$ by forming the difference $\Delta\lambda$ of the value $\lambda$ measured by said lambda probe and the desired value $\lambda_s$ integrating said difference to form a value of the integral function (FL) of said difference as a function of time; and, controlling the value of the integral function (FL) of this difference to a pregiven value (IS) over the time for a pregiven time interval.

2. The method of claim 1, wherein the degree of enrichment is equal in amount to the degree of leaning during a pregiven time interval.

3. The method of claim 1, wherein said pregiven value (IS) is zero.

4. The method of claim 1, further comprising the steps of:

utilizing a second lambda probe arranged downstream of the catalyzer; and, generating the desired value $\lambda_s$ for the lambda probe arranged upstream of the catalyzer based on the output of the second lambda probe.

5. The method of claim 4, further comprising the step of forming the desired value $\lambda_s$ from the integral of the difference of the desired value and output signal of the second lambda probe.

6. An arrangement for controlling the air/fuel ratio of an air/fuel mixture supplied to an internal combustion engine having an exhaust gas system, the arrangement comprising:

catalyzer mounted in the exhaust gas system and having a gas storage capability for storing oxygen;

a lambda probe mounted in said system upstream of said catalyzer; and, controller means for effecting a targeted enrichment and leaning of the air/fuel ratio about a pregiven desired value $\lambda_s$ by forming the difference $\Delta\lambda$ of the value $\lambda$ measured by said lambda probe and the desired value $\lambda_s$;

integrator means for forming a value of the integral function (FL) of said difference as a function of time; and, integral controller means for controlling said value of said integral function to a pregiven value (IS) over the time for a pregiven time interval.

7. The arrangement of claim 6, said controller means including ancillary control means for controlling the enrichment and leaning of said air/fuel ratio during a pregiven time interval so as to cause the quantity of enrichment to be equal in amount to the quantity of leaning.

8. The arrangement of claim 6, wherein said pregiven value (IS) is zero.

9. The arrangement of claim 6, said lambda probe being a first lambda probe, and the arrangement further comprising:

a second lambda probe mounted downstream of said catalyzer for supplying an output signal $\lambda_n$; and, generating means for generating a desired value $\lambda_s$ for said first lambda probe from said output signal $\lambda_n$ of said second lambda probe and a corresponding desired value $\lambda_{ns}$.

10. The arrangement of claim 9, said generating means including:

subtraction means for forming the difference of said desired value $\lambda_{ns}$ and said output signal $\lambda_n$; and, integrating means for integrating said difference to form said desired value $\lambda_s$ for said first lambda probe.

11. The arrangement of claim 10, further comprising interconnecting lines for interconnecting the components of the arrangement; and, at least a portion of said interconnecting lines being optical waveguides.

* * * * *